US005873625A

United States Patent [19]

Uchtman

[11] Patent Number: 5,873,625

[45] Date of Patent: Feb. 23, 1999

[54] FOLDING CHAIR WITH CANOPY

[76] Inventor: Laurence F. Uchtman, 72 Sewell Road, Tanah Merah (Queensland), Australia

[21] Appl. No.: 973,937

[22] PCT Filed: Jun. 6, 1995

[86] PCT No.: PCT/AU95/00334

§ 371 Date: Mar. 5, 1998

§ 102(e) Date: Mar. 5, 1998

[87] PCT Pub. No.: WO96/39006

PCT Pub. Date: Dec. 12, 1996

[51] Int. Cl.[6] ..... A47C 7/62

[52] U.S. Cl. ..... 297/184.15; 297/39

[58] Field of Search ..... 297/46, 39, 184.1, 297/184.15, 16.1, 35, 37, 40

[56] References Cited

U.S. PATENT DOCUMENTS

| | | | |
|---|---|---|---|
| 725,593 | 4/1903 | Schleuning . | |
| 2,166,832 | 7/1939 | Wenker | 135/5 |
| 2,243,984 | 6/1941 | Singewald | 155/139 |
| 3,879,086 | 4/1975 | Moceri | 297/184 |
| 4,030,748 | 6/1977 | Brock | 297/184 |
| 4,058,341 | 11/1977 | Prins . | |
| 5,320,405 | 6/1994 | Foster et al. | 297/184 |
| 5,375,906 | 12/1994 | Snyder . | |

FOREIGN PATENT DOCUMENTS

| | | |
|---|---|---|
| 40739 | 1/1910 | Australia . |
| 15170/92A | 12/1993 | Australia . |
| 1171778 | 1/1959 | France . |
| 2655028A | 6/1978 | Germany . |
| 3131166A | 2/1983 | Germany . |
| 4201743A | 10/1992 | Germany . |
| 434993 | 4/1949 | Italy . |
| 452664 | 11/1950 | Italy . |
| 2191648 | 8/1982 | United Kingdom . |
| WO8201984 | 6/1982 | WIPO . |
| WO9114386A | 10/1991 | WIPO . |

*Primary Examiner*—Milton Nelson, Jr.
*Attorney, Agent, or Firm*—Dann, Dorfman, Herrell and Skillman; Henry H. Skillman

[57] ABSTRACT

Personal support apparatus (10) including a lightweight foldable chair (11) having a seat (16) operatively connected to a support (19,20) for supporting the seat at a predetermined height above a foundation, a back support and an arm support (27); a shielding device (12) for shielding a portion of a user's body from the sun, and a spacing device (14) for operatively spacing the shielding device above said chair (11), said personal support apparatus being foldable to a folded altitude in which said seat is adjacent the shielding device, said spacing device including a forward pair of lightweight members (13) upstanding from the arm support (27) or an extension of the arm support and attached to said shielding device (12) and a complementary rear pair of lightweight members (14) upstanding from the back support (25) and attached to the shielding device rearwardly of the forward pair of members in a cross-over manner such that the shielding device is maintained in a stable position above a portion of the seat.

3 Claims, 1 Drawing Sheet

FOLDING CHAIR WITH CANOPY

Figure 1:
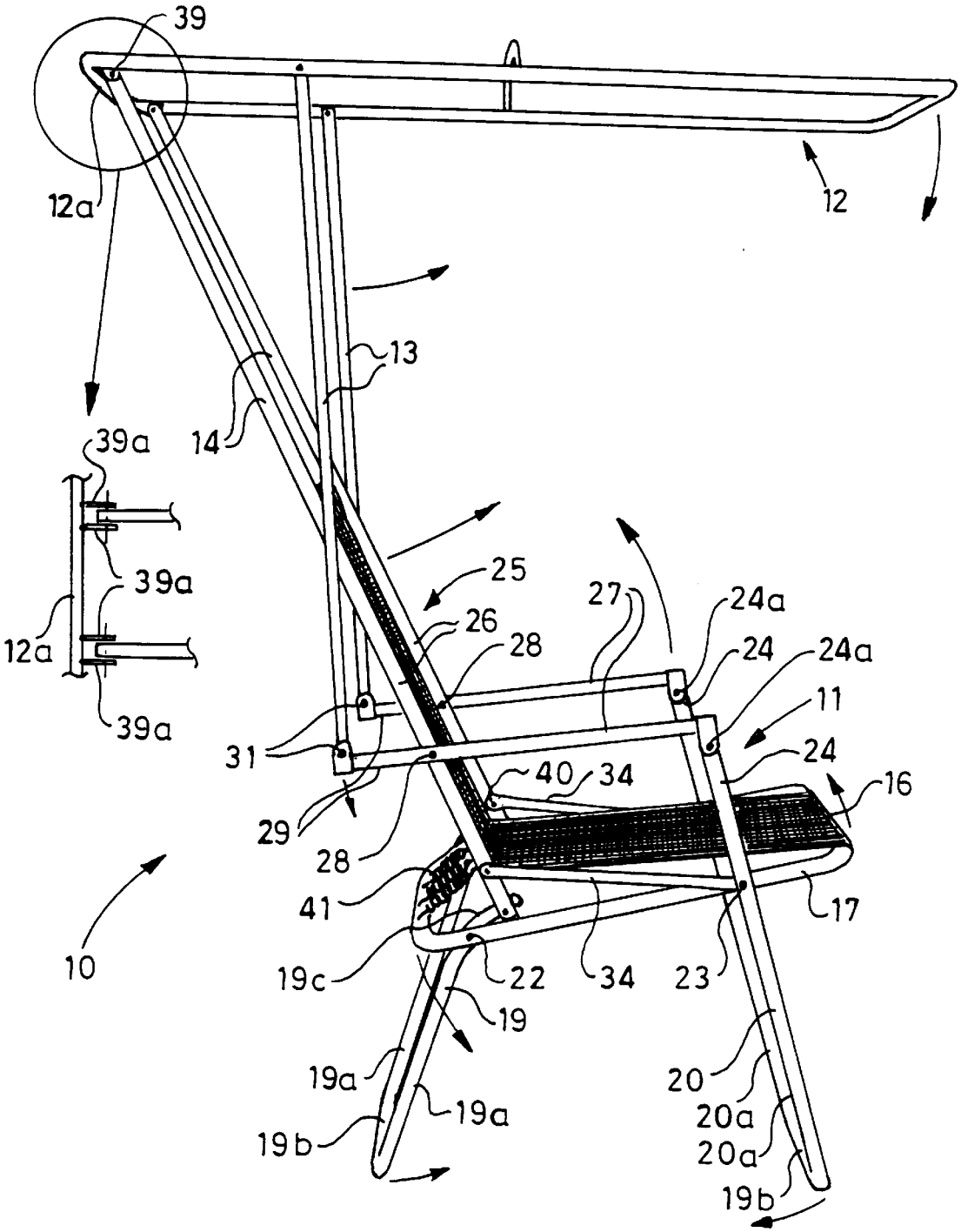

This invention relates to personal support apparatus.

This invention has particular but not exclusive application to foldable seating apparatus and for illustrative purposes reference will be made to such application. However it is to be understood that this invention could be used in other applications such as for a shaded head rest.

The presently available foldable seating apparatus are typically of relatively light weight construction and are capable of being folded to a relatively compact size. Consequently, such apparatus are easily transportable to places such as the beach and picnic grounds and events such as cricket or football matches where available seating may be inadequate. Furthermore such apparatus generally can be easily and efficiently stored. However, such apparatus does not provide sufficient protection for the user against the effects of wind, rain and sun.

This problem can be partially overcome by the use of an umbrella which may be held by the person sitting in such apparatus. However, the use of seating apparatus and umbrella in such manner has provided only partial protection and furthermore is not easily carried to places where required nor is easily stored.

The present invention aims to alleviate at least one of the above disadvantages and to provide personal support apparatus will be reliable and efficient in use.

With the foregoing in view this invention in one aspect resides broadly in personal support apparatus including:

rest means having a rest portion against which a portion of a users body may be rested or supported;

shielding means for shielding a portion of the users body from the sun, and spacing means for operatively spacing said shielding means above said rest means, said personal support apparatus being foldable to a folded attitude in which said rest means is adjacent said shielding means.

The rest means may be a head or body rest and the rest portion may support the head or back of a user but preferably the rest portion provides a seat. Such rest portion may be of a unitary construction but preferably it includes frame means having frame members selected for lightweight construction and an inner portion formed of fabric such as canvas extending between opposed frame members.

Preferably the rest means includes support means for supporting the rest portion at a predetermined height above a foundation such as the ground. Such support means may be fixedly connected to the rest portion but preferably each support means is pivotally connected to the rest portion and is pivotal from a supporting position in which the rest portion is supported at the predetermined height to a stowed position in which the support means lies substantially in the same plane as the rest portion or in a plane substantially parallel and adjacent to it.

In one form of the invention wherein the rest portion is a seat it is preferred that the rest means also includes back support means. Preferably such back support means is pivotally connected to the seat means and is pivotal from a supporting position in which the back support means may support the back of a seated user and a stowed position in which the back support means lies substantially in the same plane as the seat or in a plane substantially parallel and adjacent to it. The pivotal connection between the back support means and the seat means may be a direct connection or an indirect connection such as one wherein link means extends between the back support means and the seat. For example, the seat may be extended to provide such link means.

Preferably the rest means includes a pair of arm support means. In one form of the invention wherein the rest portion is a seat and the rest means also includes back support means it is preferred that each arm support means includes an arm supporting portion which is pivotally connected to the back support means. Preferably the arm support means are pivotal between a supporting position in which they support the arms of a seated user and a stowed position in which they lie substantially in the same plane as the seat or in a plane substantially parallel and adjacent to it.

The shielding means may be a unitary member such as a rigid canopy but preferably it includes a lightweight frame to which shade cloth, canvas or other fabric may be attached. Preferably, the shielding means is arranged such that in an unfolded attitude it is positioned above the rest means and in a folded position it lies in substantially the same plane as the rest means or in a plane substantially parallel to it.

Preferably the spacing means are rigid members which are positioned so as not to obstruct the view of a user and are operatively connected to the rest means either directly or indirectly and are pivotal from a shielding position in which the shielding means is positioned above the seat means and a folded position in which the shielding means lies substantially in the same plane as the seat means or in a plane substantially parallel to it. In a preferred form wherein the rest means includes a seat supported by support means, back support means and arm support means the spacing means comprises a pair of members upstanding from the arm support means and a complementary pair of members upstanding from the back support means in a cross over manner such that the shielding means is indirectly supported by the seat means and is maintained in a stable shielding position.

Preferably the personal support apparatus also includes securing means for securing the apparatus in the folded position or the unfolded position. Preferably the securing means is self locking wherein initiation of movement of the spacing means relative to the rest means when in the unfolded position causes unlocking of the securing means and allows folding of the apparatus and initiation of movement of the spacing means relative to the rest means when in the folded position causes unlocking of the securing means and allows unfolding of the apparatus. In a preferred form the securing means is an over centre linkage and includes tensioning means for applying a securing force between the rest means and the spacer means and is arranged to secure the apparatus in either the folded or unfolded position.

In order that this invention may be more readily understood and put into practical effect reference will now be made to the accompanying drawings which illustrate a preferred embodiment of the invention and wherein:

FIG. 1 is a pictorial representation of a personal support apparatus according to the invention in an unfolded position.

The personal support apparatus 10 illustrated in the drawing includes a chair assembly 11 and a shielding assembly 12 positioned above the chair assembly and connected to it by pairs of spacer members 13 and 14. A shade cover not shown can be attached to the shielding assembly 12 by any suitable attachment means such as velcro or clips.

The chair assembly 11 includes a seat assembly 16 comprising a substantially rectangular lightweight steel frame 17 which is supported by a rear support assembly 19 and a front support assembly 20. The rear support assembly 19 is a substantially U-shaped lightweight steel tubular structure comprising two downwardly directed leg portions 19*a* connected at their lower ends by a ground engaging portion 19*b* which takes up a roughly horizontal position on the ground when the apparatus is in an unfolded position. The leg portions 19*a* are pivotally secured by pivotal connections 22 near to their upper ends to the frame 17 near its rear frame member. The leg portions 19*a* extend upwardly beyond the pivotal connections 22 to provide a link portion 19*c* for connection of a back support assembly 25.

The front leg assembly 20 includes two opposed leg portions 20*a* connected at the lower end by ground engaging portion 20*b* extending between the leg portions so as to take up a roughly horizontal position when the apparatus is in the erected position. The front leg assembly 20 is pivotally connected to the frame 17 at pivotal connections 23. Each leg portion 20*a* extends upwardly beyond the pivotal connection 23 to provide a link member 24 for connection of arm rests 27 to their upper ends at pivotal connection 24*a*.

The arm rests 27 extend rearwardly from the extended portions 24 of the front leg assembly 20 and are pivotally connected to the back support assembly 25 such that in the erected position the arm rests 27 take up a substantially horizontal position and at the same time maintain the back support assembly 25 at a slightly inclined position. The arm rests 27 extend beyond the pivotal connection 28 to provide a link portion 29 for the pivotal connection of the support members 13 at pivotal connection 31.

The inclined side members 26 of the back support assembly 25 extend upwardly beyond the back support fabric 25*a* to form the spacer members 14.

A spacer (not shown) of length substantially equal to the diameter of tubular members 26 is arranged at the pivotal connection 22 between the leg portions 19*a* and the frame 17 so as to allow pivoting movement of the back supporting assembly 25 about the pivotal connection 28 for folding of the apparatus.

The spacer members 14 are pivotally connected to the shielding assembly 12 along a rear frame member 12*a* at pivotal connection 39 which are spaced inwardly along the member 12*a* by a distance slightly greater than the thickness of the support members 13. The pivotal connection 39 comprises a pair of spaced apart brackets 39*a* extending inwardly from the member 12*a* so as to pivotally receive a member 14 therebetween.

A pair of tension struts 34 extend between the respective front leg pivotally connections 23 to the lower portion of each back support member 26 so as to transfer back load directly to the front leg assembly.

In use the apparatus 10 is folded from the attitude shown in the drawing by pivotally moving the front and rear support assemblies 19 and 20 towards each other as shown by the arrows. Pivotal movement of the support assembly 19 forces the spacer members 14 upwardly against the springs 41 (which extend between the frame 17 and a cross member 40 connected between the back support members 26 and arranged to hold the seat fabric 16*a*) releasing the securing force. The spacer members 13 and 14 are then able to pivot towards the shielding assembly 12. Suitably the spacer members 13 and 14 rest substantially within the frame of the shielding assembly 12 when in the folded position and the folded chair assembly 11 abuts the frame members 14 and the shielding assembly 12 for easy carrying and storage.

It will of course be realised that the above has been given only by way of illustrative example of the invention and that all such modifications and variations thereto as would be apparent to persons skilled in the art are deemed to fall within the broad scope and ambit of the invention as is defined in the appended claims.

I claim:

1. A lightweight foldable chair including:

rest means having a seat means against which a portion of a users body may be rested or supported, back and arm support means foldably connected to said seat means, a rear support means supporting said seat elevated, and an over-center linkage securing the chair alternatively in a folded position in which said seat means, said back and arm support means and said rear support means are all positioned generally parallel and close to each other, and an unfolded position in which said seat means, and said back and arm support means are able to receive and support a users body;

shielding means for shielding a portion of the users body from the sun, and spacing means for operatively spacing said shielding means above said seat means and said back and arm support means when said chair is unfolded, said spacing means being foldable to a folded attitude in which said shielding means is adjacent said rest means when said rest means is in said folded position, said back and arm support means having a back component having a lower end pivotally connected to the upper end portion of the rear support means, and arm support components intermediate the seat means and the shielding means, the rear support means being pivotally connected to the seat means to provide said over-center linkage, and tensioning means for applying a securing force to selectively maintain the chair in either the folded or unfolded position.

2. A lightweight foldable chair according to claim 1 including a plurality of springs extending between the back component and the seat means forming said tensioning means.

3. A lightweight foldable chair according to claim 1 wherein said spacing means comprises two pairs of members crossing each other to maintain the shielding means stable.

* * * * *